US005842239A

United States Patent [19]

Eckelbarger

[11] Patent Number: 5,842,239

[45] **Date of Patent: *Dec. 1, 1998**

[54] HEAD AND NECK SUPPORTING DEVICE

[76] Inventor: Scott B. Eckelbarger, 11620 Victoria Ct., Carmel, Ind. 46033

[ * ] Notice: This patent issued on a continued prosecution application filed under 37 CFR 1.53(d), and is subject to the twenty year patent term provisions of 35 U.S.C. 154(a)(2).

[21] Appl. No.: 605,364

[22] Filed: Feb. 22, 1996

[51] Int. Cl.[6] ..... A45D 44/10

[52] U.S. Cl. ..... 4/523; 4/575.1; 5/636

[58] Field of Search ..... 4/519, 523, 575.1; 5/622, 636, 637

[56] References Cited

U.S. PATENT DOCUMENTS

| | | | |
|---|---|---|---|
| 2,194,804 | 3/1940 | Mayhew | 4/519 |
| 2,545,313 | 3/1951 | Sawyer | 4/523 X |
| 3,026,537 | 3/1962 | Schnell | 4/523 |
| 3,283,344 | 11/1966 | Blanchard | 5/636 X |
| 3,694,831 | 10/1972 | Treace | 5/636 X |
| 4,352,216 | 10/1982 | Grim | 4/523 |
| 4,494,261 | 1/1985 | Morrow | 5/636 |
| 4,763,364 | 8/1988 | Morgan | 4/523 |
| 4,901,378 | 2/1990 | Reddell | 4/519 X |
| 4,903,412 | 2/1990 | Pedrow | 5/636 X |
| 4,949,407 | 8/1990 | Singer et al. | 4/523 |
| 4,998,303 | 3/1991 | Smithers | 4/523 |
| 5,007,119 | 4/1991 | Yamaguchi | 4/523 |
| 5,014,371 | 5/1991 | Heel | 4/519 X |
| 5,177,820 | 1/1993 | Varallo | 4/523 |
| 5,377,365 | 1/1995 | Hakim | 4/523 |
| 5,508,334 | 4/1996 | Chen | 5/636 X |

*Primary Examiner*—Robert M. Fetsuga
*Attorney, Agent, or Firm*—Locke Reynolds

[57] ABSTRACT

A supporting device is disclosed which is intended to be attached to a hair washing basin or sink commonly employed in beauty salons, and is specifically directed to such a support which will comfortably prop the neck and the head of a person while that person is in a supine position yet leave substantially all of the hair area free to be worked.

13 Claims, 7 Drawing Sheets

10
27
18
20
28
22
29

10
22
18
28
27
20
24

20
10
24

48
52
54
50
10

24
20
28
27
18
22
10

HEAD AND NECK SUPPORTING DEVICE

BACKGROUND OF THE INVENTION

The present invention relates generally to a device for supporting the head and neck, as might be employed in connection with a basin used in washing or otherwise treating hair.

Cutting, styling or otherwise treating hair often necessitates the use of a basin for washing and rinsing the hair, for example at beauty salons, barbershops and the like. Typically, such basins are configured to include a depression which requires a person (such as a customer) who is having his or her hair treated to place his or her neck in the depression while in a supine, that is, face up, position. While in this supine position, the customer can experience discomfort and is susceptible to aggravation of pre-existing musculo-skeletal conditions or neck injuries. The head and neck are vulnerable because they are extended or hyperextended with inadequate or nonexistent support. Extension or hyperextension of the neck not only creates discomfort, but can even cause impingement of spinal nerves, impede vascular flow to the head, and may lead to other medical problems. Because the head is typically completely unsupported in the basin, excessive stresses are imposed on the anterior and posterior neck muscles and ligaments, which must attempt to support the weight of the skull. Increased bio-mechanical stresses on the musculo-skeletal structures of the neck often lead to aggravation of prior conditions, pain, and may cause serious injury if undetected pathologies exist in the neck structures.

The prior art discloses various neck supporting structures which can be received by a basin designed to accommodate hair washing. For example, in U.S. Pat. No. 5,377,365, Hakim describes a neck support for beauty salon hair washing sinks. The neck support of Hakim does not support the head and comprises a pillow formed of elastomeric foam which is incapable of properly supporting the cervical spine inasmuch as it fails to accommodate anatomical features in the neck and does not effectively minimize the likelihood of injury. Hakim also discloses a complex attaching means which utilizes a threaded bolt. In addition, in U.S. Pat. No. 4,949,407, Singer discloses a neck rest which comprises a semi-cylindrical cushion and a flap portion for attaching to a basin. The neck rest disclosed by Singer similarly does not support the head and is also ill-suited to adequately support the cervical spine.

Other approaches involve head supporting structures. For example, in U.S. Pat. No. 5,177,820, Varallo describes an adjustable, plastic hairdressing head support which contains apertures which are necessary to permit water to drain therethrough. These drainage apertures are problematic because the customer's hair is likely to become entangled therein. The head support of Varallo precludes direct contact between the water spraying nozzle associated with the basin and the customer's hair. The device disclosed by Varallo does not provide support for the neck, and the device also requires complex moving parts in the attempt to be adjustable. In addition, in U.S. Pat. No. 4,998,303, Smithers describes a concave plate which serves as a headrest. The device disclosed by Smithers lacks any neck support. According to Smithers, the hair is enclosed in the support device thereby requiring the plate to also contain a plurality of large apertures for permitting water to drain through the plate. As noted above, these types of apertures are problematic because of the significant likelihood that the customer's hair will encounter entanglement therein. The enclosed nature of the support device also prevents direct contact between the water sprayer and hair. Also, in U.S. Pat. No. 4,352,216, Grim discloses an oval head support spanned by an open mesh material. Adequate neck and cervical spine support is not available by the device described by Grim. The device taught by Grim also does not provide ample room for handling the hair, prevents direct water nozzle-hair contact, and further suffers from the likelihood that hair can become entangled in the draining mesh. Further, in U.S. Pat. No. 3,283,344, Blanchard discloses a headrest comprising an arcuate frame having a plurality of teeth to penetrate the hair of the user. The headrest described in Blanchard is ill-suited to be utilized with a hair washing basin inasmuch as the headrest does not allow the necessary maneuverability for hair washing and does not even accommodate water passage.

Despite the availability of such devices, it will be appreciated from the foregoing that there exists a need in the art for a supporting device which will attenuate the possibility of injury or aggravation of pre-existing musculo-skeletal conditions while a person is in the supine position, for example in the course of various hair treatments, by providing sufficient continuous support and comfort for the cervical spine and skull, as well as reducing physical demand to the neck muscles and ligaments. There also exists a need for a supporting device that is small and which is configured to allow for sufficient area in the basin for easy maneuverability when handling the hair, which does not preclude direct contact between the water spraying nozzle and the person's hair, and which does not promote the possibility of hair entanglement. There is a further need for a supporting device which can conform to a variety of basin sizes and shapes and which does not require cumbersome attachment pieces.

SUMMARY OF THE INVENTION

The aforesaid problems are solved, in accordance with the present invention, by a neck and head supporting device which accommodates anatomical features in the neck, cervical spine and head so as to minimize the likelihood of injury or aggravation of musculo-skeletal conditions while a person is in the supine position, such as during hair washing or other hair treatment. The head and neck supporting device of the present invention is particularly compatible with an associated basin or sink.

In accordance with the present invention, the head and neck supporting device comprises a base portion, adapted to fit a U-shaped notch of a typical commercial shampoo basin having a longitudinal midline and first and second ends. A pair of lateral neck supporting portions or neck lifts extend generally equally to either side of the midline of the base portion. The neck lifts are fixed in laterally spaced relation to the base and project upwardly in parallel from the base to a common horizontal plane, to cushion and position a neck disposed upon the neck lifts. The lateral neck supporting portions or neck lifts are thicker than the base portion so as to define vertically, a first longitudinal indentation or first space between the common horizontal plane of the neck lifts and the base sufficient to receive, without substantial contact, the spinous processes of a neck.

A first separator is positioned between the neck lifts to distance the neck lifts from each other to further define horizontally the longitudinal indentation or space so as to permit the spinous processes of the neck to be disposed, substantially unsupported, in the space between the separated neck lifts, while the neck lifts provide lateral support to the neck.

The invention also features a base extension that projects along the midline axis y from the second end of the base into the interior of the basin and rests against the basin.

A pair of head supporting portions or head lifts project upward from the base extention and are positioned on either side of the midline of the base extension. The pair of head lifts are cushioned and are fixed in laterally spaced relation to the base extension in parallel and extend upwardly from the base extension to a common horizontal plane, to cushion and position a head disposed in the basin and to define, vertically, a second space between the common horizontal plane of the head lifts and the base extension sufficient to receive, without contact, the back of a head disposed upon head lifts.

A second separator is positioned between the head lifts and distances the head lifts from each other to further define, horizontally, the second space and to permit the back of a head to be disposed, unsupported, between the head lifts, while the head lifts provide lateral support to the head. The head supporting portions or head lifts can be shaped like a pillar or column, for example, and can be fixed to the base absent the neck supporting portion or neck lifts so as to solely support the head. An appendage can extend from the first end of the base to the exterior of the basin. The appendage can be utilized to attach the head and neck supporting device to the associated basin or sink. The head and neck supporting device can be manufactured in a concave configuration, or alternatively, in a planar, flat configuration.

The head and neck supporting device of the present invention can be formed of a unitary, one-piece material, which is readily conformable and is highly compressible so as to provide cushioning support. The cushioning material can also be characterized by low surface porosity, although a surface coating, for example formed from a polyvinyl chloride copolymer resin, can be provided to decrease surface porosity. Examples of suitable materials for the one-piece embodiment include, but are not limited to, EVA copolymers, natural rubbers, polysiloxanes, thermoplastic elastomers including styrene block copolymers, polyamide block copolymers, butadiene-acrylonitrile copolymers, butadiene-isobutylene copolymers, polysulfide polymers and thermoplastic vulcanizates.

The head and neck supporting device can also be formed with one or more internal cores which can be provided to enhance structural resistance to the weight of the user's head while maintaining the necessary compressibility and cushioning by virtue of a compressible layer encasing the internal cores.

Attachment means can be provided to facilitate stability of the head and neck supporting device when disposed on the associated basin or sink. By way of example, the attachment means can be in the form of a retaining clip, which can be formed from aluminum or other metal. The retaining clip can also be coated with, for example, rubber. Alternative attachment means include an adhesive or releasable fabric, for example. Further, the head and neck supporting device can be formed from at least one material that is characterized by a low-softening temperature, such as an EVA copolymer. Such materials will soften at elevated temperatures and return to the solid state at room temperatures. Thus, the head and neck supporting device can be heated so as to soften. The softened device can then be positioned appropriately on the basin or sink and cooled to room temperature. The cooled device then remains stable and fixed to the basin during operation.

Accordingly, the present invention provides a supporting device of a type which has heretofore been needed yet has been unavailable in the art. More specifically, the present invention advantageously provides continuous support for the cervical spine, neck and head while a person is in the supine position during engagement with a basin, for example, during hair washing at a beauty salon, barbershop, or similar establishment. The head and neck support of the present invention precludes hyperextension of the head and neck and allows the person to enjoy substantial comfort while in the supine position. Significantly, the continuous support provided by the present invention eliminates or minimizes the possibility of neck injuries typically encountered while a person is in the supine position during hair washing in a basin. For example, the present invention decreases the possibility of neck pain caused by neck extension and hyperextension while in the supine position and also alleviates bio-mechanical stress on the cervical musculo-skeletal structure. In addition, the present invention also precludes direct contact of the cervical vertebrae spinous processes with the basin surface. This alleviates the pain associated with direct bone to surface contact. This is provided through the midline indentation configuration.

Advantageously, the head and neck support of the present invention is conformable and can be adapted to attach to basins having a variety of sizes and shapes. In fact, the present invention is not burdened by a complex attachment mechanism. Further, the head and neck support is relatively small whereby excessive area remains in the basin so as to allow for sufficient maneuverability for handling hair. The present invention also permits direct contact between water-spraying nozzles associated with the basin and the person's hair, while also preventing the possibility of hair entanglement in the supporting device.

The present invention will be more fully understood upon reading the following detailed description of the preferred embodiment in conjunction with the accompanying drawings.

DETAILED DESCRIPTION OF THE PREFERRED EMBODIMENTS

The following portion of the specification, taken in conjunction with the drawings, sets forth the preferred embodiment of the present invention. The embodiments of the invention disclosed herein include the best mode contemplated by the inventor for carrying out the invention in a commercial environment, although it should be understood that various modifications can be accomplished within the parameters of the present invention.

Figure 1:
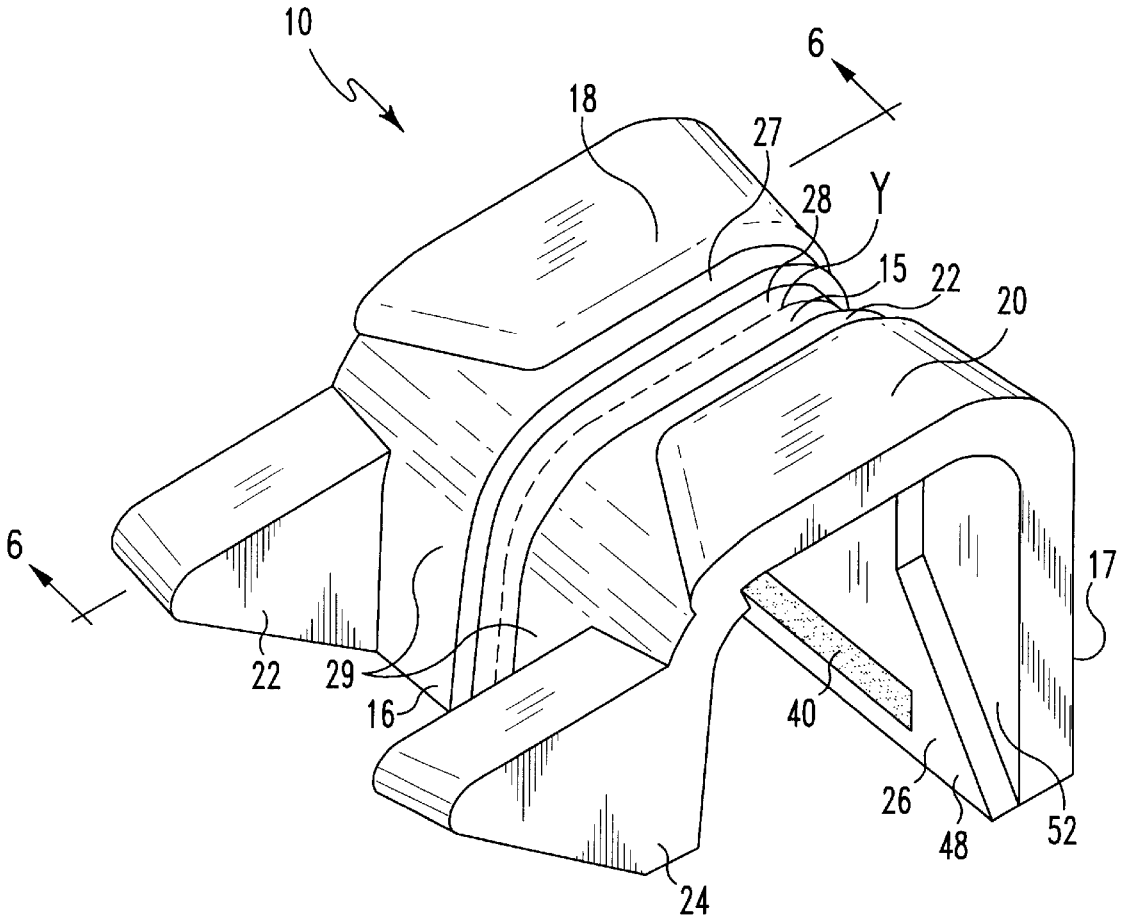
FIG. 1 illustrates a perspective view of a first exemplary embodiment of a head and neck support in a concave configuration, in accordance with the present invention.
Figure 2:
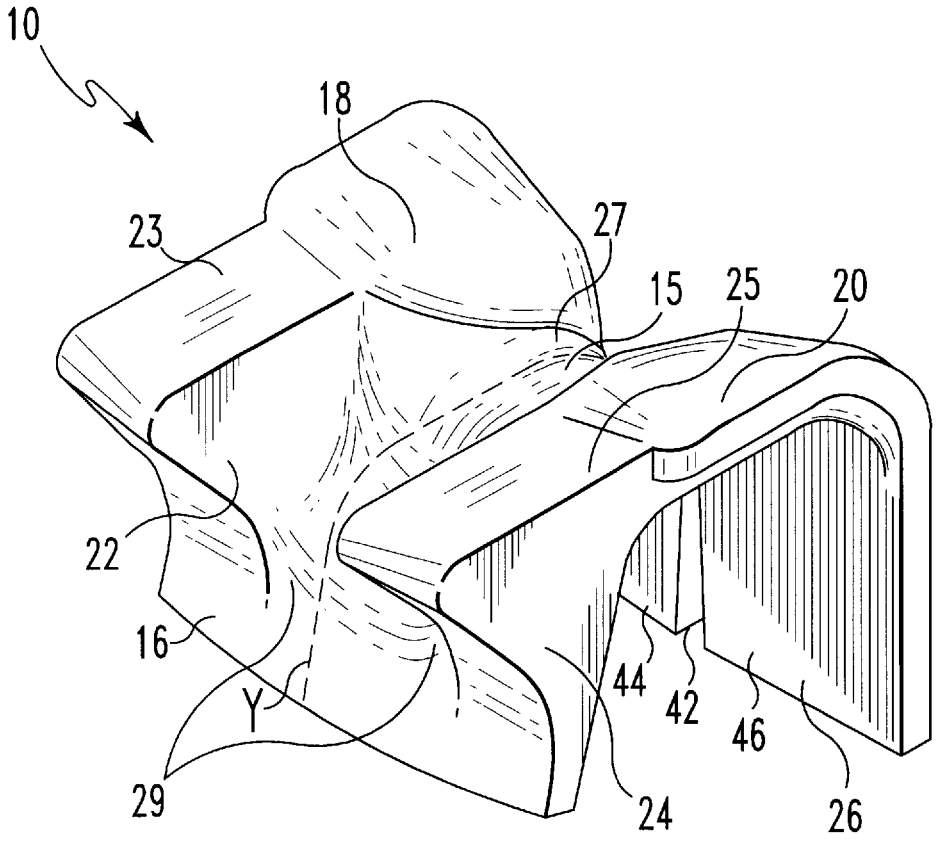
FIG. 2 illustrates a perspective view of a second exemplary embodiment of a head and neck support in a concave configuration, in accordance with the present invention.
Figure 3:
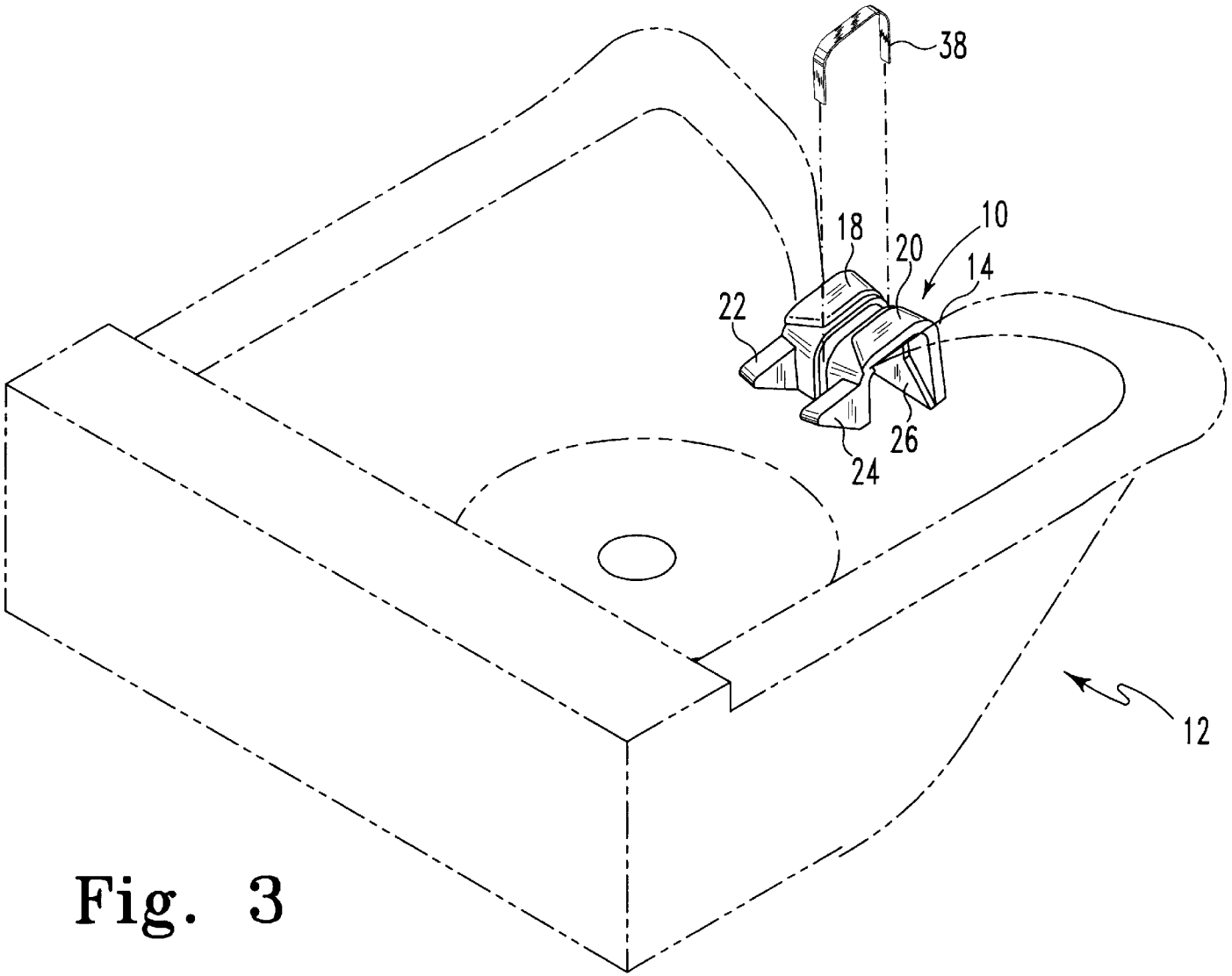
FIG. 3 illustrates a perspective view of a head and neck support as shown in FIG. 1, as attached to a basin.

Referring now to the drawings for a detailed description of the present invention, reference is first made to FIGS. 1–2, generally depicting two separate exemplary alternative embodiments of a head and neck support 10 in accordance with the present invention. Referring now to FIG. 3, the head and neck support 10 has particular utility when disposed on an associated basin 12 used for washing or otherwise treating a person's hair. The basin 12 comprises a U-shaped notch 14 which can be utilized to dispose the head and neck support 10 thereon. Although FIG. 3 depicts the use of the head and neck support 10 shown in FIG. 1 with the basin 12, it is noted that other configurations of the head and neck support 10 under the present invention, including the head and neck support shown in FIG. 2, can also be utilized with basin 12.

As seen in FIGS. 1–2, the head and neck support 10 comprises a base portion 15 adapted to fit a U-shaped neck receiving notch 14 of a basin 12 having a midline axis Y extending from a first end 16 to a second end 17. A pair of lateral neck supporting portions or neck lifts 18 and 20 extend generally equally to either side of the midline axis Y of the base portion 15. The neck lifts 18 and 20, are fixed in laterally spaced relation to the base and project upwardly in parallel from the base to a common horizontal plane, to cushion and position a neck disposed upon the neck lifts. The lateral neck supporting portions or neck lifts, 18 and 20, are thicker than the base portion 15 so as to define, vertically, a first longitudinal indentation or first space sufficient to receive, without substantial contact, the spinous processes of a neck disposed upon the neck lifts.

A first separator 27 is positioned between the neck lifts 18 and 20 to distance the neck lifts 18 and 20 from each other and to further define, horizontally, the first space and to permit the spinous processes of the neck to be disposed, substantially unsupported, between the neck lifts 18 and 20, while the neck lifts provide lateral support to the neck.

A base extension 19 extends from the second end of the base 15 and projects from the base 15 along the midline axis Y into the interior of the basin 12 and rests against the basin 12. A pair of head supporting bolster portions or head lifts 22 and 24 project upward from the base extention 19 and are positioned on either side of the midline axis Y, and the bolster portions or head lifts 22 and 24 are generally equidistant from the midline axis Y. The head lifts 22 and 24 are fixed laterally along the base extension and project upwardly from the base extension 19 to a common, substantially horizontal, plane, to cushion and position a head disposed in the basin 12 and to define, vertically, a second longitudinal indentation or second space between the common horizontal plane of the head lifts and the base extension sufficient to receive, without contact, the back of a head disposed upon the head lifts.

A second separator 29 is positioned between the head lifts to distance the head lifts from each other to further define the longitudinal indentation or space so as to permit the back of a head to be disposed, unsupported, between the head lifts 22 and 24, while the head lifts 22 and 24 provide lateral support to the head. The head and neck supporting portions or head lifts 22 and 24 can be positioned at a common horizontal plane that is lower than the common horizontal plane of the neck supporting portions or neck lifts 18 and 20 so as to accommodate the natural anatomical features of the human body while in the supine position thereby enhancing comfort and support. An appendage 26 can be defined by the first end 16 of the base 15, or formed at the first end 16 of the base 15, so as to facilitate attachment of the head and neck support 10 to the basin 12.

The head and neck support may include an interior channel 28 that extends along the midline Y-axis of the base and the base extension to facilitate neck support by providing additional space for receiving the cervical spinous processes and can also facilitate attachment of the head and neck support 10 to the basin 12, as will be described hereinbelow.

The head and neck support 10 can be formed from a unitary, one-piece material that is relatively conformable. The material selected for a one-piece head and neck support 10 preferably is relatively soft, should provide cushioning, and should be relatively compressible. One of ordinary skill in the art will appreciate that "Durometer" is a typical measure of compressibility. Durometer is an inverse measure of compressibility, that is, materials with a low Durometer are highly compressible, and materials with higher Durometers have lower compressibility. For example, the one-piece material can be formed from a material, such as rubber, having a Durometer ranging from about 30-A to about 50-A (measured on a shore A). Further, the material is preferably characterized by low surface porosity so as to minimize the possibility of chemicals utilized in the hair treatment or washing procedure from entering or interfering with the head and neck support 10. Although water can typically be less harmful than many chemicals involved in hair treatment, a low surface porosity would also limit the possibility of water entering or interfering with the head and neck support 10.

Generally, examples of suitable materials that can be used in such a one-piece embodiment include, but are not limited to, ethylene-vinyl acetate copolymer (EVA), natural rubbers, polysiloxanes, thermoplastic elastomers including styrene block copolymers, copolyesters, polyurethane block copolymers, polyamide block copolymers, butadiene-acrylonitrile copolymers, butadiene-isobutylene copolymers, polysulfide polymers, and thermoplastic vulcanizates. These exemplary materials are noted because they enable the head and neck support 10 to readily conform to a variety of sizes and shapes of basins 12, and particularly to a variety of sizes and U-shaped notch 14 which is utilized to receive the head and neck support 10. Polysiloxane rubbers are especially desirable inasmuch as they include silicones, which are relatively inert materials.

Figure 5:
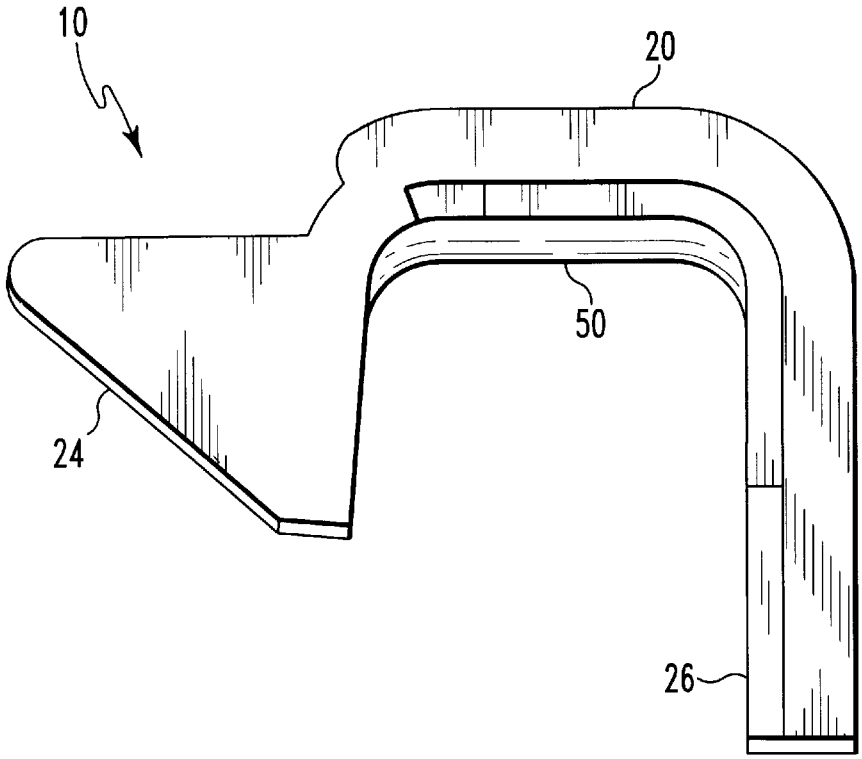
FIG. 5 illustrates a side elevation view of a head and neck support as shown in FIG. 1.
Figure 6:
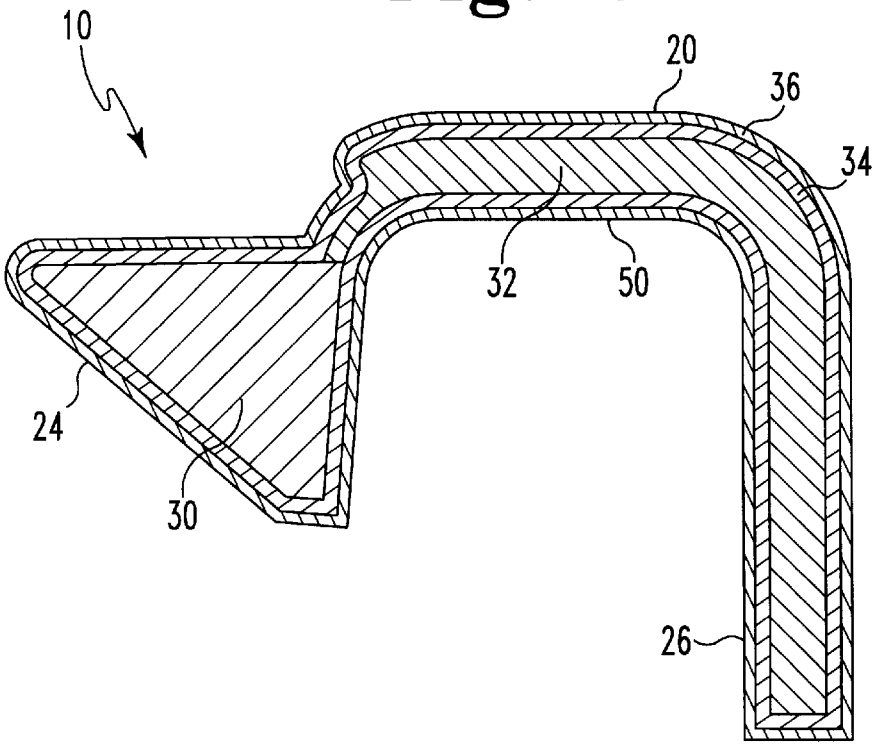
FIG. 6 illustrates a side cross-sectional view of a head and neck support as shown in FIG. 1, taken along the line 6—6, and further including internal core portions.

During manufacture, the head and neck support 10 can be molded in a variety of shapes, which can then be conformed in use to a specific shape of a basin 12. For example, the head and neck support 10 can be molded with the base 15 relatively planar, or flat, as seen in FIGS. 7–11. This flat configuration is capable of being conformed to a shape which is compatible with the basin 12 and the depression U-shaped notch 14. Preferably, the head and neck support 10 can alternatively be molded with the base 15 in a relatively concave configuration, as best seen in FIGS. 5–6. Manufacturing the head and neck support 10 with a concave base 15 facilitates conformability of the head and neck support 10 to the shape of a specific U-shaped notch 14, which is typically configured so as to require the base 15 to be conformed into a concave shape for allowing the head and neck support 10 to be received by the depression U-shaped notch 14.

As noted hereinabove, the head and neck support 10 can be formed from a unitary, one-piece structure. However, the head and neck support 10 can alternatively be formed of two or more different materials, and the head and neck support 10 can also form more than one layer of different materials. As shown in FIG. 6, the head and neck support 10 can be formed with one or more internal cores 30 and 32 (two are shown) surrounded by a readily conformable layer 34, which can preferably correspond to a material described hereinabove for the unitary, one-piece embodiments under the present invention. The core 30 is disposed in an interior of each of the bolster portions or head lifts 22 and 24 and is utilized to provide inner support for the bolster portions or head lifts 22 and 24 which support the user's head. Meanwhile, the core 32 is generally elongated and can extend from the bolster portions or head lifts 22 and 24 through the lateral neck portions or neck lifts 18 and 20 and into the appendage 26, as seen in FIG. 6. The elongated core 32 is provided to instill the head and neck support 10 with some internal strength while still not impeding the ability of the head and neck support 10 to conform to a particular basin 12. It is noted that the cores 30 and 32 can also be formed together to form a single combined core of a single material.

The bolster core 30 can be formed from a substantially rigid material such as a hard rubber or a plastic cast material. The presence of the core 30 enables the head and neck support 10 to exhibit some structural resistance and provides strength to maximize the ability of the head and neck support 10 to support the weight of the user's head. The readily conformable layer 34 can be molded around the internal bolster core 30 so as to also supply the necessary compressibility and cushioning to enhance the comfort of the user. The core 30 should have a higher resistance to compression than the conformable layer 34 so as to translate or transfer the weight of the person's head to the inside of basin 12.

The elongated core 32 should also be less conformable than the conformable layer 34. Because Durometer is an inverse measure of compressibility, the inner cores 30 and 32 each should therefore have a higher Durometer value than the conformable layer 34. Although the conformable layer 34 can be more compressible than the cores 30 and 32, the cores 30 and 32 should also possess some amount of compressibility. Both cores 30 and 32 should not only be less compressible than the conformable layer 34, but the cores 30 and 32 should also be formed of a material which is capable of bonding or otherwise combining with the selected conformable layer 34.

The elongated core 32 can be formed of a material which is a solid at room temperature, but which will soften and become more flexible when heated to an elevated temperature, for example during exposure to boiling water. Accordingly, the elongated core 32 can be formed, for example, from a plastic having a low temperature softening point such as an EVA copolymer. This trait for the elongated core 32 is advantageous because the head and neck support 10 can be molded in a variety of configurations, then subjected to sufficient heat to soften the elongated core 32, and then easily conformed and positioned on a particular basin 12. After the head and neck support 10 cools, the elongated core 32 will return to the solid state, with the head and neck support 10 of the desired configuration engaging with the basin 12.

Generally, the elongated core 32 need not be as rigid as the bolster core 30. In fact, the elongated core 32 should not be so rigid as to diminish the ability of the head and neck support 10 to conform to the shape of the basin 12. If a single material is used for both cores 30 and 32, or for a combined singular core, the material should most preferably be able to provide sufficient strength to support the user's head by the bolster portions 22 and 24, while also being able to supply the head and neck support 10 with a measure of internal support while still allowing the head and neck support 10 to be conformable to the design of the basin 12. It is further noted that one or both cores 30 and 32 can be absent from the head and neck support 10 of the present invention.

A surface layer 36 can be provided on the outer surface of the head and neck support 10 for reducing the surface porosity of the head and neck support 10. The surface layer 36 can be, for example, in the form of a coating or a very thin layer. The surface layer 36 is selected from materials that give the surface of the head and neck support 10 an enhanced characteristic of low or negligible surface porosity. One of ordinary skill in the art will appreciate that a coating comprising a polyvinyl chloride copolymer resin, for example, can be utilized to minimize surface porosity. As noted above, low surface porosity is important to ensure that chemicals employed during the hair treatment process do not react or otherwise interfere with the materials present in the head and neck support 10. Although of somewhat less importance, the low or negligible surface porosity supplied by the surface layer 36 likewise prevents or reduces the opportunity for water to combine with the head and neck support 10.

Figures 7, 8, 9, 10, 11:
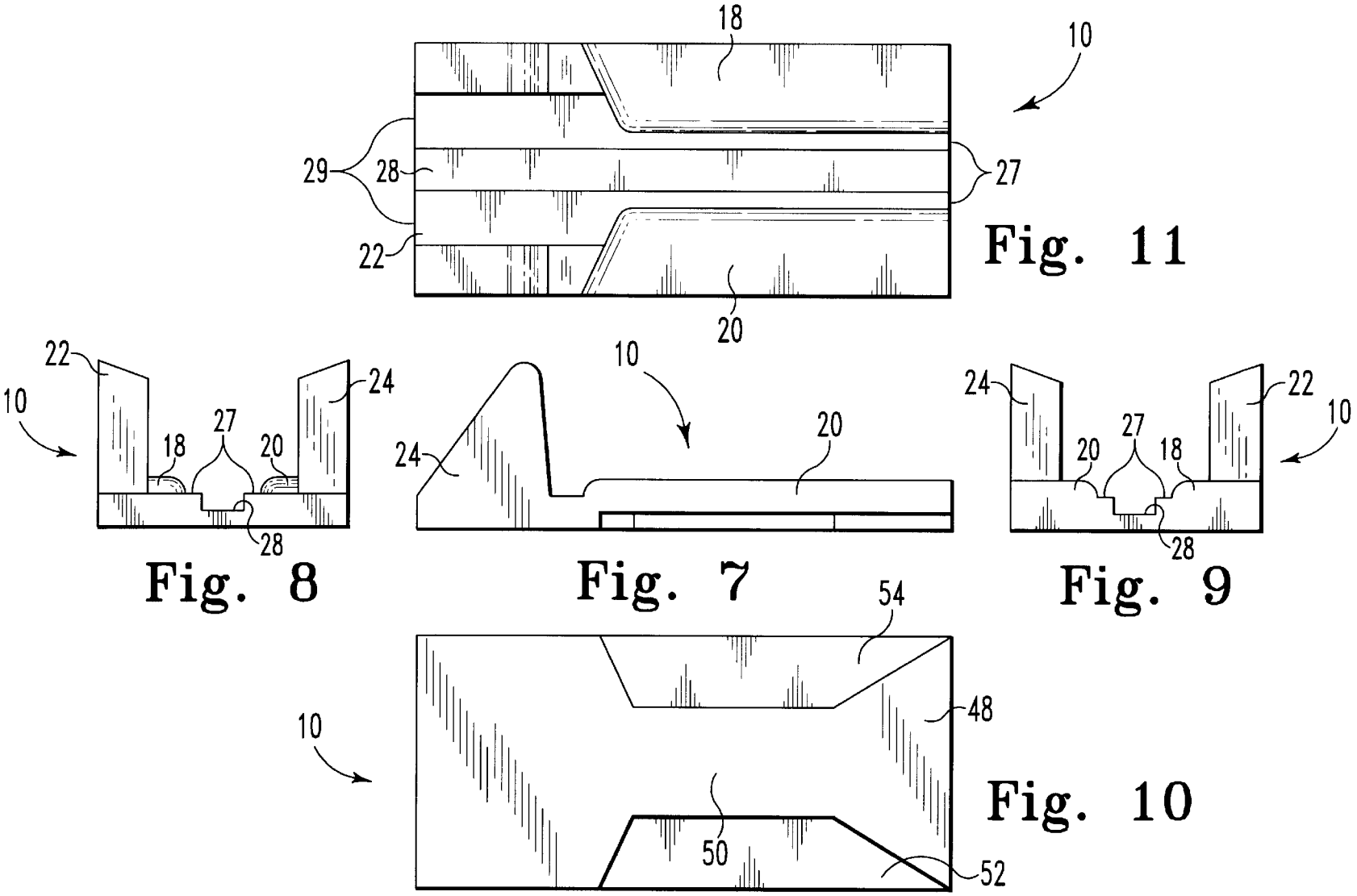
FIG. 7 illustrates a side elevation view of the head and neck support as shown in FIG. 1, but in a flat, nonconcave configuration.
FIG. 8 illustrates a front view of the head and neck support as shown in FIG. 7, viewed from the left side of FIG. 7.
FIG. 9 illustrates a rear view of the head and neck support as shown in FIG. 7, viewed from the right side of FIG. 7.
FIG. 10 illustrates a bottom plan view of the head and neck support as shown in FIG. 7.
FIG. 11 illustrates a top plan view of the head and neck support as shown in FIG. 7.

Referring to FIGS. 8–9 the first and second separators 27 and 29 can be seen while the head and neck support 10 is in the planar configuration. As noted hereinabove, the planar configuration can be conformed to accommodate the shape of U-shaped notch 14 of basin 12 in a concave configuration. It is noted for clarity of description that interior channel 28 can be considerably more rounded than depicted.

Attachment means can be provided to secure the head and neck support 10 to the basin 12 in a stable manner. For example, the attachment means can comprise a retaining clip 38, as seen in FIG. 3. The retaining clip 38 can be removably received by at least a portion of the interior channel 28. However, the retaining clip 38 can alternatively be attached elsewhere on the head and neck supporting device 10. The retaining clip 38 can be formed from any of a number of metals, preferably aluminum. In addition, the retaining clip 38 can be coated with a rubber or plastic material. The retaining clip 38 can be provided in various sizes so as to be compatible with basins 12 of various sizes. Further, the retaining clip 38 is preferably conformable to accommodate various basin 12 sizes.

As seen in FIG. 1, an adhesive 40 can be utilized as an alternative to the retaining clip 38, or even in addition to the retaining clip 38. The adhesive 40 can be in the form of a strip which can preferably be provided on the appendage 26 or elsewhere on the head and neck support 10 or even on the basin 12. The adhesive 40 can have a releasable lining, which can be in the form of paper, disposed thereon. In order to secure the head and neck support 10 to the basin 12, the releasable lining can be removed so as to expose the adhesive 40. The adhesive 40 can then be utilized to attach the head and neck support to basin 12. It is noted that the head and neck support 10 of the present invention can comprise other types of attachment means, including a releasable fabric such as VELCRO or other closure that contains a piece of fabric of small hooks that sticks to a corresponding fabric of small loops.

The attachment means is not required. By way of example, at least a portion of the head and neck support 10 can be formed from a material exhibiting a low temperature softening point, such as an EVA copolymer. Such materials soften at elevated temperatures yet return to the solid state at room temperature. Accordingly, the head and neck support 10, having at least a portion comprised of a material characterized by a low softening point, such as an EVA copolymer, can be heated so as to soften the material. The softened material can then be readily conformed to the shape of the U-shaped notch 14 of the basin 12. After the head and neck support is cooled to room temperature, the head and neck support 10 remains disposed on the basin 12 in a stable manner, without the attachment means.

The appendage 26 can be utilized to facilitate positioning of the head and neck support 10 on the basin 12. As noted hereinabove, the attachment means can be provided on the appendage 26. Also, the attachment means can be provided on the basin 12, with the appendage 26 attached thereto. The appendage 26 can be provided with a slit 42 which serves to form a bifurcated appendage 26, having two portions 44 and 46, as seen in FIG. 2. It is noted that the slit 42 can be provided during manufacture, or alternatively, a dashed or perforated line can be provided during manufacture which can outline a position for the user/purchaser to enter the slit 42. The bifurcated appendage 26 alleviates stress on the head and neck support 10 when disposed on the basin 12. More specifically, the bifurcated appendage 26 enables the head and neck support 10 to be disposed on the basin 12 without ripping or tearing. Ripping or tearing can otherwise occur because of the readily conformable nature of the head and neck support 10 of the present invention.

However, the slit 42 is not required under the present invention. The head and neck support 10 can also be configured so as to accommodate the shape of the U-shaped notch 14 of the basin 12 so as to preclude the possibility of tearing. Particularly, the head and neck support can be provided with a flap portion 48, which alleviates stress on the conformable head and neck support 10 during engagement with basin 12. As best seen in FIGS. 1 and 10, the flap portion 48 forms a thicker area on a bottom surface 50 of the base portion 15 which corresponds to the lowermost point of a typical U-shaped notch 14 of the basin 12. A pair of peripheral portions 52 and 54 of the base 15 are thinner than the flap portion 48 and correspond to the upwardly rising sides of U-shaped notch 14 of the basin 12. Accordingly, the peripheral portions 52 and 54 are shaped so as to minimize the possibility of tearing of the head and neck support 10. It is noted that the flap portion 48 can be formed in configurations other than that shown in the drawings but still appropriately define thinner peripheral portions 52 and 54 which accommodate the shape of the depression 14 of various basins 12. For example, the triangular shape shown in the figures is not necessary, but can be provided to enhance space for application of an adhesive, VELCRO or the like, or other attaching means. It is further noted that the slit 42 can also be used as an alternative or in conjunction with the flap portion 48 and peripheral portions 52 and 54.

Figure 4:
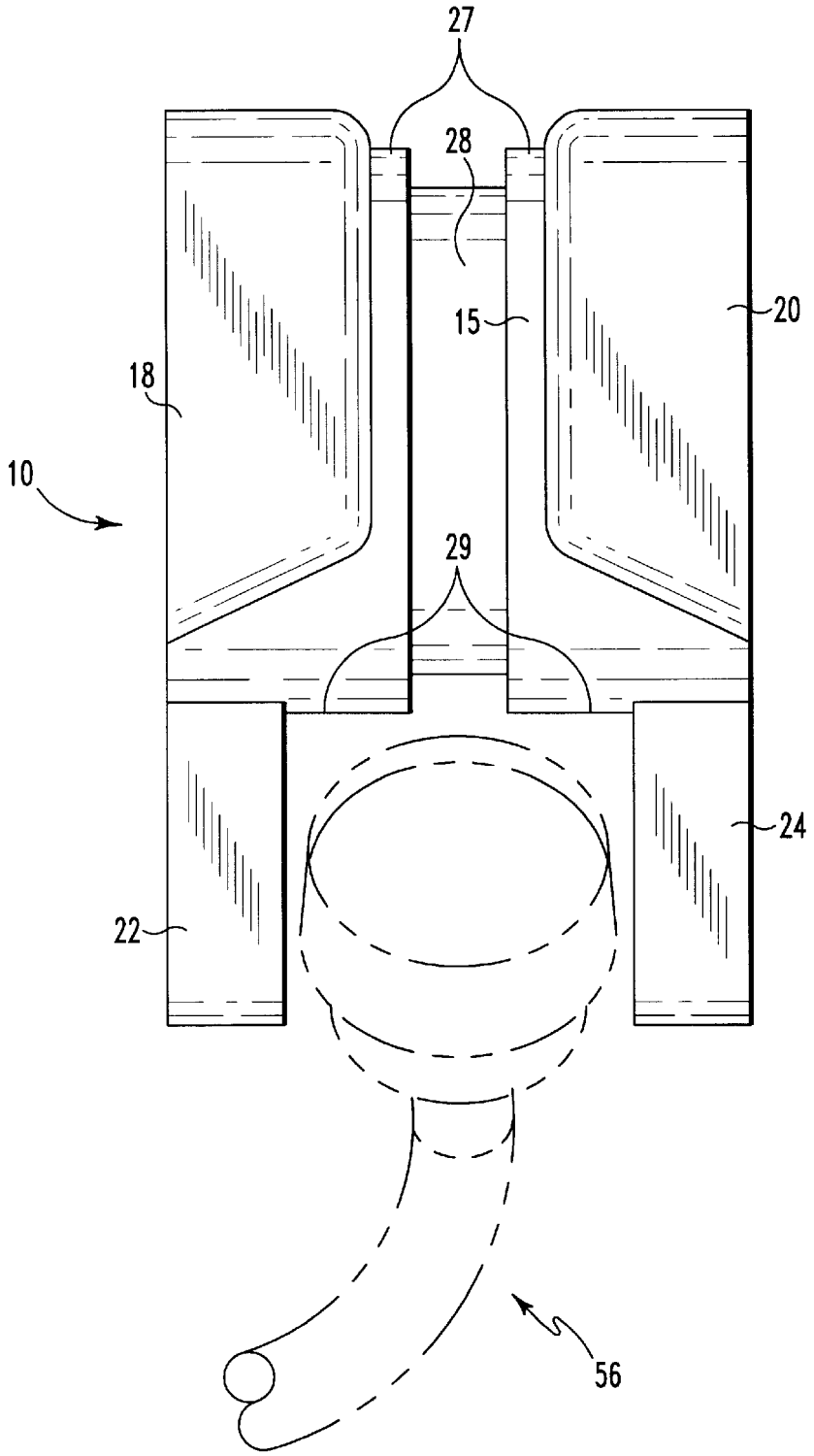
FIG. 4 illustrates a top plan view of a head and neck support as shown in FIG. 1, with a water-spraying nozzle shown in phantom in relation thereto.

Turning now to exemplary dimensions for the head and neck support 10 of the present invention, the head supporting bolster portions or head lifts 22 and 24 can be, for example, about 2.250 inches (≈5.77 cm) apart. This distance is large enough to accommodate the size of a typical water nozzle 56, as shown in FIG. 4, and is also spaced apart appropriately so as to properly support the user's head while permitting the back of a head to be disposed, unsupported, between the head lifts 22 and 24. The height of the head supporting bolster portions or head lifts 22 and 24 can be, for example, about 1.750 inches (≈4.49 cm). The width of the head supporting bolster portions or head lifts 22 and 24 can be about 0.75 inches (≈1.92 cm). The lateral neck supporting portions or head lifts 18 and 20 can be, for example, at least 0.25 inches (≈0.64 cm) thicker than the base portion 15. The width of the head and neck support 10 can be, for example, about 3.750 inches (≈9.62 cm). It will be appreciated from this that the first separator 27 can be dimensioned to separate the neck lifts 18 and 20, for example, by about 3.25 inches (≈8.26 cm). It is emphasized that these dimensions are merely exemplary and can be varied as desired.

Figure 12:
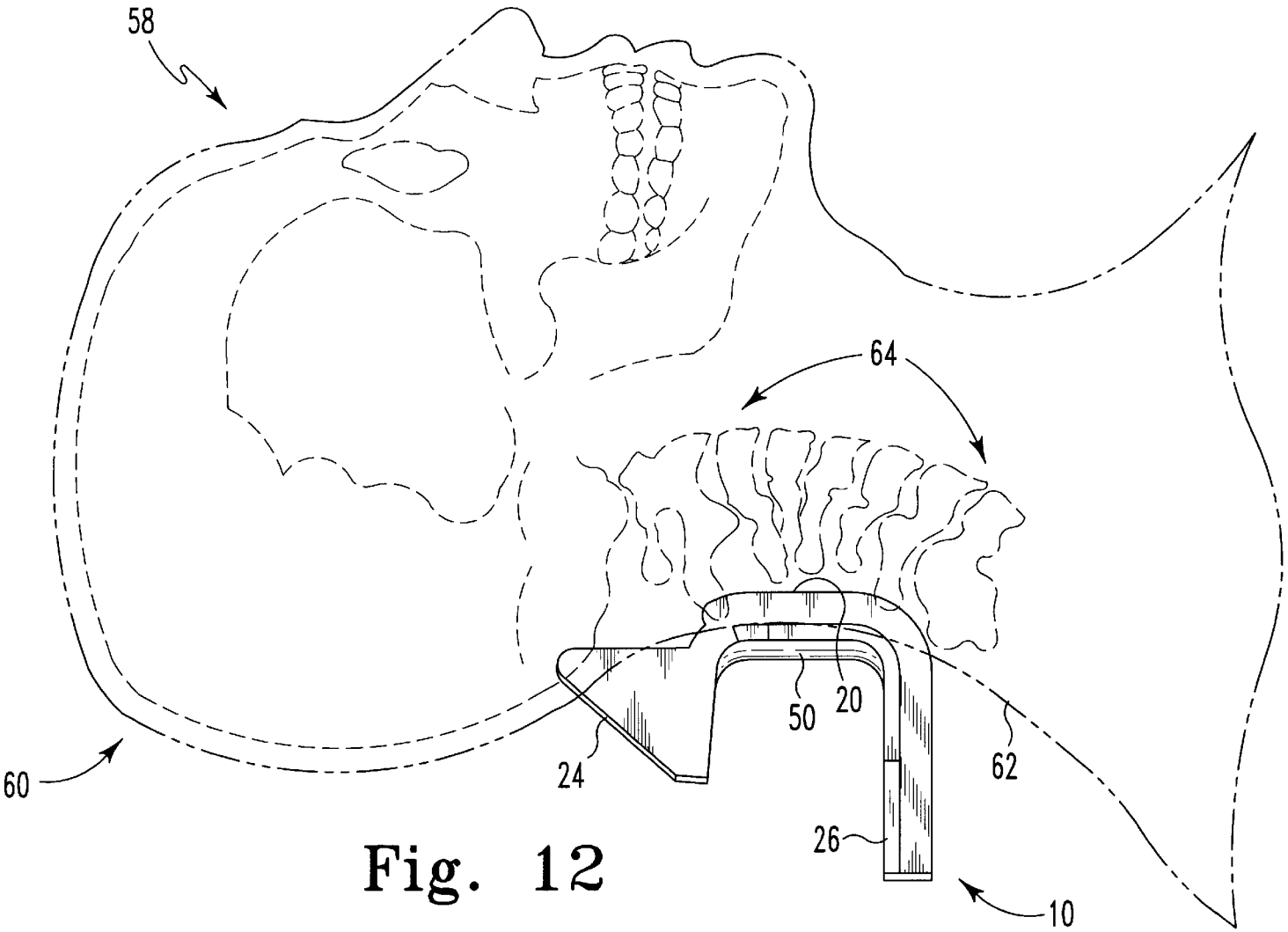
FIG. 12 illustrates a schematic side elevation view of a head and neck support as shown in FIG. 5, schematically depicting a person in alignment with the head and neck support during use.

In operation, the head and neck support 10 enables a user to enjoy substantial comfort while in the supine position while also minimizing bio-mechanical stresses on the musculo-skeletal structure of the neck as well as reducing susceptibility to injury. Referring to FIG. 12, the user 58 can prop his or her head 60 on the bolster portions or head lifts 22 (only one can be seen) at two laterally spaced points. A part of the head 60 extends downward between the bolster portions 22 and 24. However, the head 60 does not contact the base portion 15. As noted hereinabove, the common horizontal plane of the bolster portions or head lifts 22 and 24 are positioned at a lower horizontal plane than the common horizontal plane of the neck supporting portions or neck lifts 18 and 20 so as to accommodate the natural anatomy of the human body while in the supine position.

The user 58 can also prop his or her neck 62 on the lateral neck supporting portions 18 (only one can be seen). The user's 58 lateral neck muscles are supported by the lateral neck supporting portions or neck lifts 18. In accordance with the present invention, the user's cervical spinous processes 64 do not contact the base portion 15. As seen in FIG. 12, the user's 58 neck 62 and cervical spinous processes 64 extend between the neck supporting portions or neck lifts 18 and 20, yet the cervical spinous processes 64 do not substantially contact the base 15 because the spinal processes 64 do not substantially contact the base portion 15, the user 58 enjoys substantial comfort, with minimal chance of injury or pain.

While the preferred embodiment of the invention has been disclosed, it should be appreciated that the invention is susceptible of modification without departing from the spirit of the invention or the scope of the subjoined claims.

What is claimed is:

1. A head and neck support for use in a U-shaped neck receiving notch defining part of the boundary between the interior and exterior of a typical commercial shampoo basin, the support comprising:

a base adapted to fit a U-shaped neck receiving notch of a typical commercial shampoo basin;

a pair of cushioned neck lifts fixed to the base and projecting in laterally spaced relation upwardly and, substantially, in parallel from the base to a common horizontal plane, to cushion and position a neck disposed upon the lifts, and to define, vertically, a first space between the common horizontal plane of the neck lifts, and the base, sufficient to receive, without substantial contact, the spinous processes of a neck;

a first separator positioned between the neck lifts to distance the neck lifts from each other to further define, horizontally, the longitudinal indentation or space so as to permit the spinous processes of the neck to be disposed, substantially unsupported, between the neck lifts, while the lifts provide lateral support to the neck;

a base extension projecting from the base into the basin and resting against the basin;

a pair of cushioned head lifts fixed to the base extension and projecting in laterally spaced relation upwardly and, substantially, in parallel from the base to a common horizontal plane to cushion and position a head disposed upon the lifts, and to define vertically, a second space between the common horizontal plane of the head lifts, and the base extension, sufficient to receive, without contact, the back of a head; and a second separator positioned between the head lifts to distance the head lifts from each other to further define, horizontally, the second space and to permit the back of a head disposed in the basin to be disposed, unsupported between the head lifts, while the lifts provide lateral support to the head.

2. The head and neck support of claim 1 wherein at least the base extension is bifurcated to allow variable lateral displacement of the head and neck support.

3. The head and neck support of claim 1 further comprising attachment means for attaching the head and neck support to the basin.

4. The head and neck support of claim 3 wherein the attachment means comprises an adhesive.

5. The head and neck support of claim 3 wherein the attachment means comprises a retaining clip.

6. The head and neck support of claim 1 wherein each of the or head lifts include an inclined surface providing continuous support from the neck to the head.

7. The head and neck support of claim 1 further comprising a thickened flap portion on a bottom surface which defines thinner peripheral portions which accommodate a configuration of a depression in the basin so as to minimize the possibility of tearing the head and neck support.

8. The head and neck support of claim 1 comprising a material having a Durometer ranging from about 30-A to about 50-A selected from the group consisting of ethylene-vinyl acetate copolymer, natural rubber, polysiloxanes, thermoplastic elastomers including styrene block copolymers, copolyesters, polyurethane block copolymers, polyamide block copolymers, butadiene-acrylonitrile copolymers, butadiene-isobutylene copolymers, polysulfide polymers, and thermoplastic vulcanizates.

9. A head and neck supporting device of claim 1 further comprising a surface coating for minimizing surface porosity of the head and neck support.

10. A head and neck support as defined in claim 9 wherein the surface coating comprises a polyvinyl chloride copolymer resin.

11. A head and neck support as defined in claim 1 wherein the base forms a tiered configuration so as to define at least one longitudinal indentation.

12. A combination of a head and neck support and a basin comprising:

a basin having a sidewall defining an inside and an outside, the sidewall including a U-shaped notch for receiving the neck of a person situated outside the basin so that the person's head is disposed inside the basin;

a base situated in the depression, the base including a base portion having a first end outside the sidewall of the basin and a second end inside the sidewall of the basin, the base portion also having a longitudinal axis running from the first end to the second end;

a pair of cushioned neck lifts fixed to the base and projecting in laterally spaced relation upwardly and, substantially, in parallel from the base to a common horizontal plane, to cushion and position a neck disposed upon the lifts, and to define, vertically, a first space between the common horizontal plane of the neck lifts, and the base, sufficient to receive, without substantial contact, the spinous processes of a neck;

a first separator positioned between the neck lifts to distance the neck lifts from each other to further define, horizontally, the longitudinal indentation or space so as to permit the spinous processes of the neck to be disposed, substantially unsupported, between the neck lifts, while the lifts provide lateral support to the neck;

a base extension projecting from the base into the basin and resting against the basin;

a pair of cushioned head lifts fixed to the base extension and projecting in laterally spaced relation upwardly and, substantially, in parallel from the base to a common horizontal plane to cushion and position a head disposed upon the lifts, and to define vertically, a second space between the common horizontal plane of the head lifts, and the base extension, sufficient to receive, without contact, the back of a head;

a second separator positioned between the head lifts to distance the head lifts from each other to further define, horizontally, the second space and to permit the back of a head disposed in the basin to be disposed, unsupported between the head lifts, while the lifts provide lateral support to the head; and an attachment means for attaching the support to the basin.

13. A head supporting device for use with a fixed basin comprising:

a base portion having a longitudinal axis;

a pair of cushioned head lifts fixed to the base extension and projecting in laterally spaced relation upwardly and, substantially, in parallel from the base to a common horizontal plane to cushion and position a head disposed upon the lifts, and to define vertically, a second space between the common horizontal plane of the head lifts, and the base extension, sufficient to receive, without contact, the back of a head;

a second separator positioned between the head lifts to distance the head lifts from each other to further define, horizontally, the second space and to permit the back of a head disposed in the basin to be disposed, unsupported between the head lifts, while the lifts provide lateral support to the head; and means for removably attaching the device to a fixed basin.

* * * * *